United States Patent [19]

Börner et al.

[11] 4,124,525

[45] Nov. 7, 1978

[54] PROCESS FOR WORKING UP URANIUM-THORIUM WASTES

[75] Inventors: Paul Börner, Freigericht; Hans-Jörg Isensee, Bruchköbel, both of Germany

[73] Assignee: Nukem GmbH, Hanau, Germany

[21] Appl. No.: 760,146

[22] Filed: Jan. 17, 1977

[30] Foreign Application Priority Data

Jan. 20, 1976 [DE] Fed. Rep. of Germany ..... 2601912

[51] Int. Cl.[2] ..... G21F 9/30

[52] U.S. Cl. ..... 252/301.1 W

[58] Field of Search ..... 252/301.1 R; 423/4, 423/18, 20

[56] References Cited

U.S. PATENT DOCUMENTS 3,535,264 10/1970 Hackstein et al. ..... 252/301.1 R 3,573,217 3/1971 van der Plas et al. ..... 252/301.1 R 3,669,632 6/1972 Kanij et al. ..... 252/301.1 R

OTHER PUBLICATIONS

Stoller et al., Eds., *Reactor Handbook, vol. II, Fuel Reprocessing,* Interscience Publishers, Inc., New York, 1961, pp. 60–64.

*Primary Examiner*—Benjamin R. Padgett

*Assistant Examiner*—Deborah L. Kyle

*Attorney, Agent, or Firm*—Cushman, Darby & Cushman

[57] ABSTRACT

There is provided a process for working up and returning without lost waste into the process of casting kernels of uranium-thorium oxide by dissolving the wastes in a nitric acid-hydrofluoric acid mixture and neutralizing the strongly acid solution before the addition to the casting solution. The strong nitric acid solution is evaporated up to the appearance of nitrous gas, the residue diluted with water and this solution brought to a pH of 2.5 to 3.5 with ammonia at a temperature below 40° C.

5 Claims, No Drawings

PROCESS FOR WORKING UP URANIUM-THORIUM WASTES

BACKGROUND OF THE INVENTION

The invention concerns a process which makes possible without expensive uranium-thorium separation the return without loss of uranium-thorium wastes in the form of a stable uranium-thorium solution in the production-casting process. In this process no byproducts are formed which could cause an additional waste problem.

To prepare high temperature reactor-fuel elements there are needed $(U,Th)O_2$ particles having defined uranium-thorium ratios and specific particle properties. These particles are formed by the kernel casting process under special conditions and are solidified by drying, sintering and coating, e.g., see German Auslegeschrift No. 1,542,346 and related Hackstein U.S. Pat. No. 3,535,264. The entire disclosure of the Hackstein U.S. patent is hereby incorporated by reference and relied upon.

The kernel casting solution consists of a uranyl nitrate-thorium nitrate solution and a polyvinyl alcohol solution which are mixed together in specific ratios shortly before the casting process. Viscosity, pH and ammonium nitrate content substantially influence the formation of kernels and particle shape and therefore must be held within defined limits.

Numerous processes are known for the preparation of the valuable $(U,Th)O_2$ waste ocurring in the various production steps in the form of, e.g., powders, kernels or particles, practically all of which have as the object the separation of uranium and thorium and therewith the separate return of uranium and thorium.

Thereby there were used exclusively extractive processes which brought about a separation of uranium and thorium from different nitric acid solutions by means of tributyl phosphate (Swiss Pat. No. 442,257) or other extracting agents (AAEC-Report TM310). In other processes thorium was separated through oxalate precipitation and the uranium recovered by purification precipitation or extraction.

However, these processes have various disadvantages. First extraction processes are very expensive and require a large expenditure of time and apparatus. Furthermore, in the working up byproducts occur and therefore, a recovering of uranium and thorium without loss in the casting process is not possible.

A direct recovery of the uranium-thorium solution obtained by dissolving $(U,Th)O_2$ scrap in nitric acid-hydrofluoric acid was not previously accomplished since in the neutralization of the 6–8N nitric acid solution with ammonia uranium and thorium are precipitated. However, this neutralization is necessary in order to be able to again employ the solution in the production process.

SUMMARY OF THE INVENTION

Therefore it was the problem of the present invention to develop a process for working up and the return without loss of uranium-thorium wastes into the kernel casting process which does not require an extractive separation step and in which there is no precipitation of the metal hydroxide in the neutralization of a nitric acid uranium-thorium solution.

This problem was solved by evaporating a solution of uranium-thorium oxide waste dissolved in a nitric acid-hydrofluoric acid mixture up to the appearance of nitrous gases, the residue diluted in the hot condition with water and this solution brought to a pH between 2.5 and 3.5 with ammonia at a temperature below 40° C.

The solution recovered by the process of the invention can be adjusted to any heavy metal (i.e., uranium-thorium) concentration up to about 300 grams/l at a pH of 3 to 3.5, is stable for over one month and is miscible with PVA (polyvinyl alcohol). This solution can be adjusted through further addition of uranium or thorium to the desired uranium-thorium ratio for the casting solution.

The nitric acid-hydrofluoric acid solution can contain for example $HNO_3$ and HF in a molar ratio of from 100 to 1 to 400 to 1. The exact concentration of the nitric acid is not critical so long as it is strong enough that the mixture has a pH of not over 1.

According to the invention, all wastes can be returned without loss during the production process. This is likewise true for wastes which have a uranium-thorium ratio deviating from the current production.

The $(U,Th)O_2$— waste is, in a given case after suitable pretreatment for removal of carbon and coating, dissolved with double the volume amount of $HNO_3$ (65%) and 0.06N hydrofluoric acid (based on the $HNO_3$) in a flask equipped with a reflux condensor. The time up to complete solution depends on the degree of fineness and the U-Th ratio of the scrap. The solution is then freed of excess $HNO_3$/HF by distilling twice. Thereby air or another gas is introduced for stirring up and delaying boiling in the heavy syruplike solution. Distillation was continued to the appearance of $NO_2$ vapors. The thickened residue must still be diluted in the hot state portionwise with water. Generally, it is diluted with water to a heavy metal concentration of 500 to 650 g/l. Since the pH is around 1 it is still not possible to form a U-Th sol in this condition. In the subsequent neutralization to pH 2.5 to 3.5 with ammonia the solution must be unconditionally held below 40° C. in order to prevent a sol formation at a pH above 2, which sol is made known by a dark red color.

The thus recovered, mostly yellow U/Th solution containing about 250 g/l of heavy metal can be added in any amount to the casting solution and yields after customary casting and further treatment particles which correspond to the known production quality, as well as after coating.

The process can comprise, consist essentially of or consist of the steps set forth employing the stated materials.

The process of the invention will be explained further in the following examples. Unless otherwise indicated, all parts and percentages are by weight.

DESCRIPTION OF THE PREFERRED EMBODIMENTS

EXAMPLE 1

From assorted uncoated nuclear waste there were dissolved 3 kg of uranium-thorium (corresponding to 3.410 kg of $(U,Th)O_2$) in 6.8 liters of $HNO_3$ (65%) and 17 ml of HF (40% ) with boiling using a reflux condenser. Depending on the order of fineness the time for dissolving was 30 to 70 hours.

By replacing the reflux condenser with a distillation bridge having a condenser connected thereto as well as a definite introduction of gases or air there were next carefully distilled off 4.4 liters of nitric acid. The syrupy residue was diluted with 3 liters of water and neutralized cold by the addition of about 1.5 liters of $NH_4OH$ (25%) to a pH of 2.5 to 2.8. By filling up to a final volume of 12 liters at 20° C. there was formed a solution containing about 250 g/l of heavy metal.

The typical analysis of such a solution for example yields the following concentrations and impurities:

| | |
|---|---|
| Thorium | 220.0 g/l |
| Uranium | 27.6 g/l |
| Ammonium nitrate | 133.5 g/l |
| Boron | 15 ppm |
| Fluorine | 2400 ppm |
| Silicon | <30 ppm |

This solution which is maintainable for weeks was mixed with two different casting formulations with final concentrations of 120 g/l. The nuclei cast and sintered therefrom corresponded to the customary quality requirements in regard to chemical and physical properties.

Thus, the following analytical values were found for example for sintered kernels with an average atomic ratio of U to Th of 1:10 produced with an addition of 10 to 20% scrap.

| (a) Kernels with 10% Addition of Scrap | |
|---|---|
| Thorium | 79.80% |
| Uranium | 8.23% |
| Atomic weight ratio U/Th | 1:9.7 |
| Boron | ≦0.5 ppm |
| Fluorine | <3.0 ppm |
| Silicon | 50.0 ppm |

| (b) Kernels with 20% Addition of Scrap | |
|---|---|
| Thorium | 79.87% |
| Uranium | 8.02% |
| Atomic weight ratio U/Th | 1:9.6 |
| Boron | ≦0.5 ppm |
| Fluorine | 5.0 ppm |
| Silicon | 38.0 ppm |

EXAMPLE 2

About 4 kg of nuclear waste coated with pyrolytic carbon were applied to flat sheets and annealed at 800° C. with introduction of moist air. Then 3 kg U/Th corresponding to 3.410 kg $(U,Th)O_2$ were weighed out and as described in Example 1 dissolved with boiling in 6.8 liters of $HNO_3$ (65%) and 17 ml of HF (40%) and further treated up to obtaining of the solution neutralized to a pH of 2.5.

The average atomic weight ratio of U/Th = 1.8 in the scrap was maintained in the solution and yielded at about 260 g/l of heavy metal the following concentrations per kg of solution (density of the solution at 20° C. = about 1.4):

| | |
|---|---|
| Thorium | 158.5 g |
| Uranium | 19.82 g |
| Ammonium nitrate | 191.0 g |
| Boron | 12 ppm |
| Fluorine | 2040 ppm |
| Silicon | <30 ppm |

This solution was used as a 20% addition to a plant-casting solution formulation. In the casting of these mixtures and customary further working there were formed $(U,Th)O_2$ particles with the same properties as the particles recovered from the original casting solution. The analysis of the particles produced showed the following values:

| | |
|---|---|
| Thorium | 78.05% |
| Uranium | 9.85% |
| Atomic weight ratio U/Th | 1:7.92 |
| Boron | <0.08 ppm |
| Fluorine | <3.00 ppm |
| Silicon | 7.00 ppm |

What is claimed is:

1. A process for working up waste consisting essentially of uranium-thorium oxide and returning it without loss into a process for forming kernels of uranium-thorium oxide by casting, comprising dissolving the uranium and thorium containing waste in a strongly acid nitric acid-hydrofluoric acid mixture, evaporating the strongly acid solution until the appearance of nitrogen oxide gas, diluting the hot residue with water and neutralizing the solution to a pH of 2.5 to 3.5 with ammonia at a temperature below 40° C.

2. A process according to claim 1 wherein the nitric acid-hydrofluoric acid solution after evaporation and dilution and prior to neutralization with ammonia has a pH of not over about 1.

3. A process according to claim 1 wherein the molar ratio of $HNO_3$ to HF is from 100:1 to 400:1.

4. A process according to claim 3 wherein the nitric acid-hydrofluoric acid solution after evaporation and dilution and prior to neutralization with ammonia has a pH of not over about 1.

5. A process according to claim 4 wherein the dilution prior to neutralization is to a heavy metal concentration of 500 to 650 g/l.

* * * * *